US005845741A

United States Patent [19]

Dwyer

[11] Patent Number: 5,845,741

[45] Date of Patent: Dec. 8, 1998

[54] ESCAPE APPARATUS

[75] Inventor: Anthony Frederick Dwyer, London, England

[73] Assignees: A. F. Dwyer; D. M. Dwyer; A M Dwyer, all of London, England

[21] Appl. No.: 793,385

[22] PCT Filed: Aug. 30, 1995

[86] PCT No.: PCT/GB95/01844

§ 371 Date: May 9, 1997

§ 102(e) Date: May 9, 1997

[87] PCT Pub. No.: WO96/04454

PCT Pub. Date: Feb. 15, 1996

[30] Foreign Application Priority Data

Aug. 4, 1994 [GB] United Kingdom ..... 9415794

[51] Int. Cl.[6] ..... E06C 9/14

[52] U.S. Cl. ..... 182/84; 182/95

[58] Field of Search ..... 182/84, 93, 70, 182/85, 95

[56] References Cited

U.S. PATENT DOCUMENTS

| | | | |
|---|---|---|---|
| 261,847 | 8/1882 | Graff | 182/84 |
| 755,666 | 3/1904 | Horton . | |
| 906,954 | 12/1908 | Sponholz | 182/84 |
| 1,032,810 | 7/1912 | Bosnyakovitz | 182/84 |
| 1,196,419 | 8/1916 | Banyovits | 182/84 |
| 2,662,681 | 12/1953 | Stapleton . | |
| 3,012,626 | 12/1961 | Marryatt . | |
| 3,042,141 | 7/1962 | Hartman . | |

FOREIGN PATENT DOCUMENTS

| | | |
|---|---|---|
| 215843 | 11/1909 | Germany . |

*Primary Examiner*—Alvin C. Chin-Shue
*Attorney, Agent, or Firm*—Hancock Meininger & Porter LLP

[57] ABSTRACT

An escape apparatus for installation within an upper storey of a building in the proximity of an emergency exit opening, such as a window, comprises a foldable ladder carried by a stage which is mounted on a vertically positioned fixed mounting frame for sliding and pivoting movement together with the folded ladder between a retracted position against the mounting frame to an extended position of use in which the stage projects through the emergency exit opening and in which the ladder may be slid along the stage and unfolded at a leading edge of the stage to form a rigid ladder extending downwardly from the stage outside the building. The escape apparatus may also comprise a child carrier guided by the ladder for controllably lowering a baby or small child down the ladder and an automatically opening folding rescue platform for providing a temporary place of safety for escapes unable to reach the ground while they wait for rescue.

16 Claims, 3 Drawing Sheets

ESCAPE APPARATUS

THE PRESENT INVENTION relates to an escape apparatus for installation in an upper storey of a building in the proximity of an emergency exit opening, such as a window, to enable escape from the upper storey of the building in the event of an emergency, such as a fire in the building.

It is an object of the present invention to provide a folding escape ladder apparatus which may be compactly installed in the proximity of the emergency exit and which can be easily and reliably unfolded and extended through the emergency exit when required.

Accordingly, the present invention provides an escape apparatus for installation within an upper storey of a building in the proximity of an emergency opening such as a window, which apparatus comprises a foldable ladder carried by a stage which is mounted on a fixed mounting frame for movement together with the folded ladder between a retracted position against the mounting frame to an extended position of use in which the stage projects through the emergency exit opening and in which the ladder may be unfolded from the stage to form a rigid ladder extending downwardly from the stage outside the building.

In order that the invention may be more readily understood, embodiments thereof will now be described, by way of example, with reference to the accompanying drawings, in which.

Figure 1:
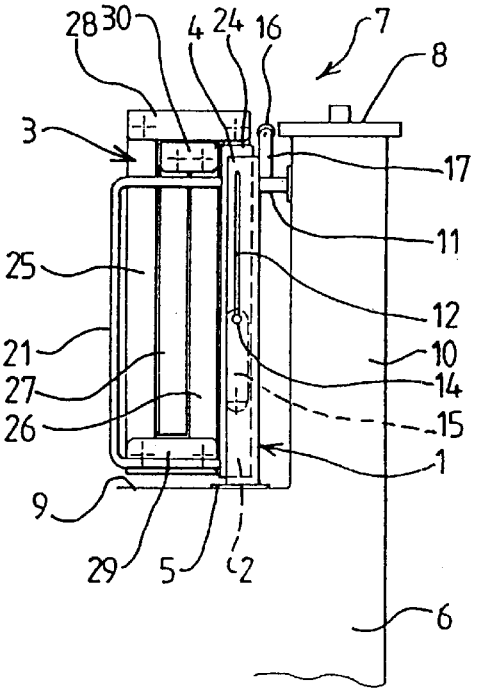
FIG. 1 is a schematic side view of a first embodiment of an escape apparatus according to the invention in a normal stowed condition.
Figure 3:
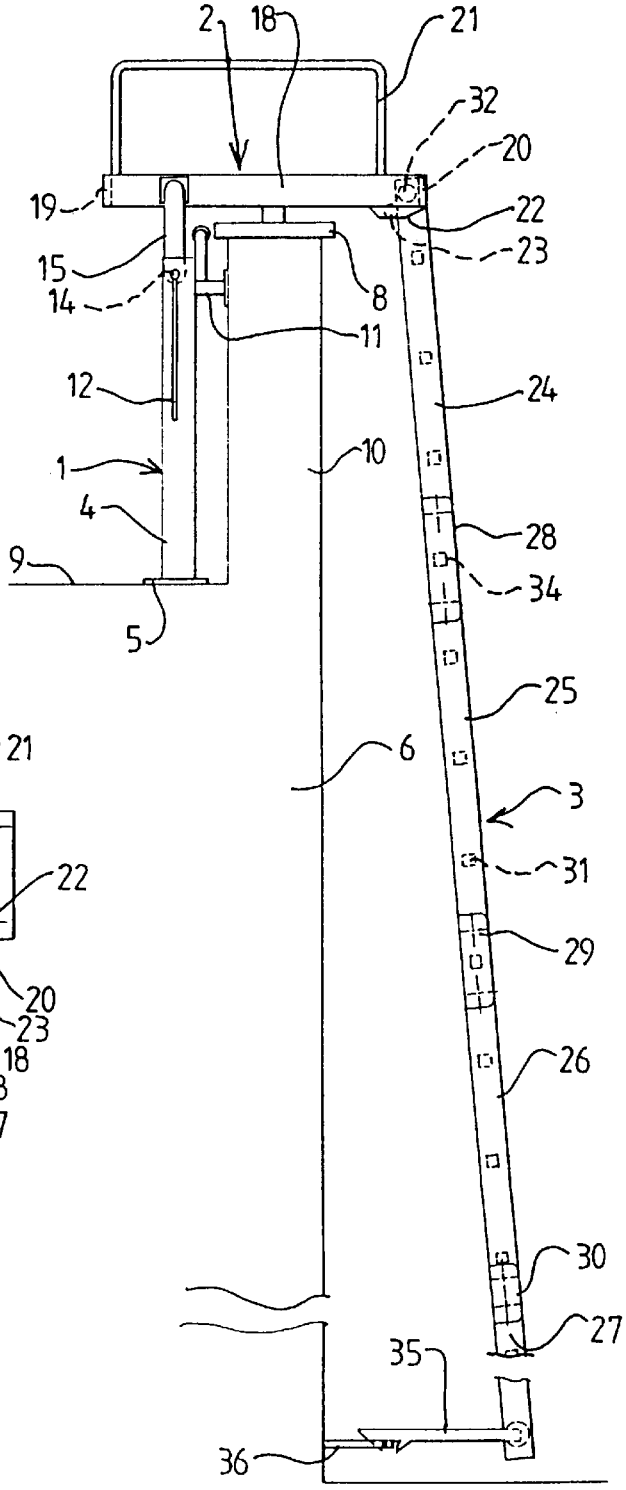
FIG. 3 is a schematic side view showing the stage of the Figure escape apparatus in its position of use with the ladder unfolded to form a rigid ladder extending downwardly from the stage.
Figure 2:
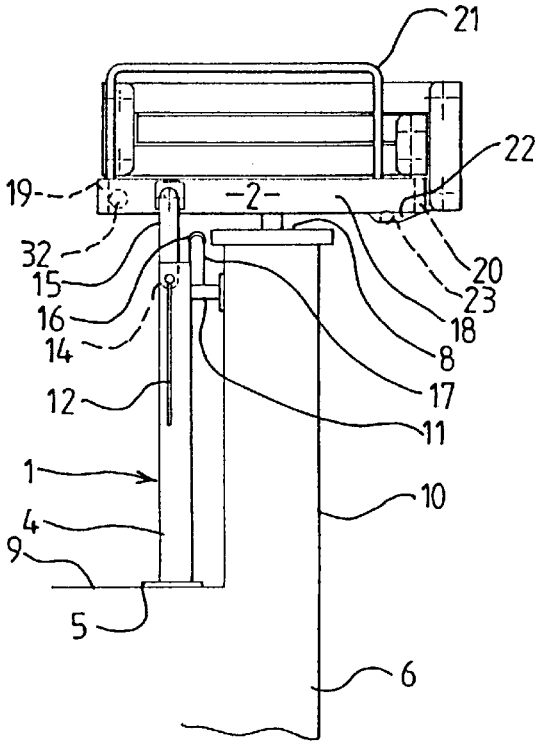
FIG. 2 is a schematic side view showing the stage of the FIG. 1 escape apparatus in an extended position of use and a foldable ladder of the apparatus in a folded condition on the stage.

Referring firstly to FIGS. 1 to 3 of the drawings, a first embodiment of an escape apparatus according to the present invention comprises a fixed mounting frame 1, a stage 2 movable with respect to the mounting frame 1 and a foldable ladder 3 movable with respect to the stage 2.

The mounting frame 1 comprises a pair of parallel uprights 4 defining a slideway therebetween. The uprights 4 stand on respective plate like feet 5 and are interconnected by cross-bracing (not shown). The mounting frame 1 is installed in an upper storey of a building 6 in the proximity of an emergency opening, in the present case a window 7 having a sill 8. The feet 5 of the uprights 4 are secured to a floor 9 of the upper storey and the uprights 4 are secured to the wall 10 of the building below the window 7 by means of respective fixing arms 11. The length of the fixing arms 11 may be chosen so as to space the frame 1 sufficiently from the wall 10 to accommodate a central heating radiator or other obstruction (not shown) between the frame 1 and the wall. The height of the mounting frame 1 may also be selected in accordance with the available height between the floor 9 and the sill 8 of the window.

Each of the uprights 4 is formed with a longitudinal slot 12 which slidably accommodates a link pin 14 pivotally connected to one end of an elongate link plate 15, the other end of which is pivotally attached to the stage 2.

A stage guide roller 16 is positioned parallel to the floor at the level of the window sill 8 and is supported at each end by a vertically extending support arm 17 which is rigidly attached to the mounting frame 1.

The stage 2 comprises a pair of channel-shaped parallel side members 18 which are interconnected at trailing ends thereof by a transverse brace 19 which closes the trailing ends of the members 18. A leading end of each of the side members 18 is closed by a stop 20 so that each member 18 defines a channel with closed ends. A respective safety rail 21 of suitable height, that is able to be accommodated within the height available when the window 7 is open, is mounted on each of the side members 18 of the stage 2. The link plates 15 are connected to the outside surfaces of the respective side members 18 of the stage 2 towards the trailing ends of the side members 18. A ladder guide roller 23 extends transversely between the side members 18 towards the leading ends of the side members 18, the roller 23 being supported at each of its ends by a bracket 22 depending from the respective side member 18. The stage 2 may, if required, be provided with a floor plate extending between the side members 18 between the brace 19 and the second guide roller 23.

The foldable ladder 3 comprises four rigid ladder sections 24, 25, 26 and 27 which are pivotally interconnected end-to-end by three U-shaped brackets 28, 29 and 30 and have equally spaced rungs 31. A free end of the first ladder section 24 carries a pair of rollers 32 which are captively engaged in the respective channels of the side members 18 of the stage 2 and are movable therealong between the closed trailing and leading ends of the members. The length of the four ladder sections 24 to 27 decreases progressively from the first ladder section 24 to the fourth ladder section and the brackets 28, 29 and 30 are of decreasing length, thereby enabling the ladder 3 to be folded in a coiled fashion, starting with the shortest ladder section 27 so as to arrive at the folded condition of the ladder 3 shown in FIGS. 1 and 2 in which the shorter sections of the ladder are accommodated within the longer sections and the first section 24 is located between the side members 18 of the stage 2.

The first and second brackets 28 and 29 carry additional rungs 34 to preserve the even spacing of the rungs along the extended ladder 3 and all three brackets 28, 29, 30 may be fitted with locking catches (not shown) which engage automatically when the ladder is unfolded to render the ladder entirely rigid.

The fourth ladder section 27 is fitted with latching means in the form of a drop-down hook 35 for automatically engaging a bracket 36 mounted on the wall of the building or on the ground when the ladder 3 is unrolled from the stage 2 in order to hold the bottom of the ladder in a fixed position and prevent unnerving movement of the ladder as an escapee is descending.

FIG. 1 shows the escape apparatus in its normal stowed or stored condition with the ladder 3 folded against the stage 2 and the stage 2 received between the uprights 4 of the mounting frame 1.

In order to ready the escape apparatus for use, the stage 2 and the ladder 3 are slid vertically upwards as a body relative to the mounting frame 1 by grasping the safety rails 21 of the stage 2 and lifting, thereby sliding the link pins 14 along the slots 12. This upward movement of the stage 2 and ladder 3 is continued until the link pins 14 reach the top of the slots 12. In this position, the stage 2 extends from the upper end of the frame 1 parallel to the frame 1. The stage 2 and ladder 3 are then pivoted about the link pins 14 to move the stage 2 into the horizontal position of use shown in FIG. 2, the stage guide roller 16 facilitating the pivoting movement of the stage 2 between the vertically extended position and the horizontal position of use.

With the stage 2 in its position of use, the folded ladder 3 can then be pushed along the stage 2, so that the rollers 32 travel from the trailing ends to the leading ends of the side members 18 of the stage 2. When the rollers 32 reach the leading end of the stage 2, the folded ladder 3 pivots about the guide roller 23 and, with the rollers captive in the side members 18, automatically unfolds under the action of gravity to form a rigid ladder extending downwardly from the leading edges of the stage 2 down to or near to the ground, thereby enabling the occupants of the upper stormy of the building to escape downwardly away from the smoke and heat of a fire or from some other emergency.

The described escape apparatus may be made of any suitable rigid material, for example aluminum, and the fixing of the mounting frame 1 to the wall or floor of the upper storey of the building may be achieved using any known fasteners which provide a suitably secure fixing for this purpose.

Figure 7:
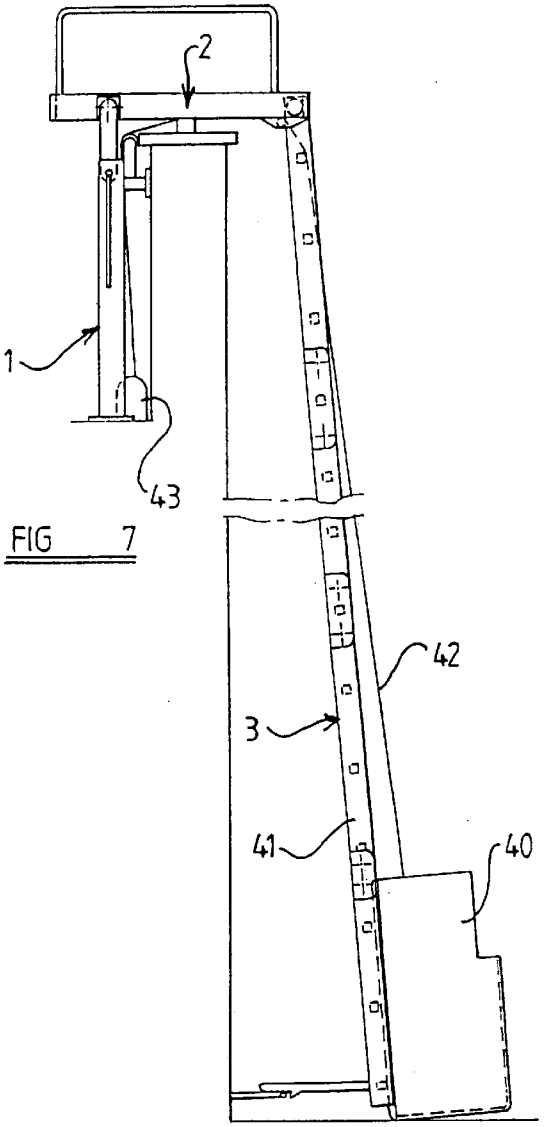
FIG. 7 is a schematic side view of the FIG. 4 escape apparatus showing the child carrier lowered to the bottom of the ladder.
Figure 6:
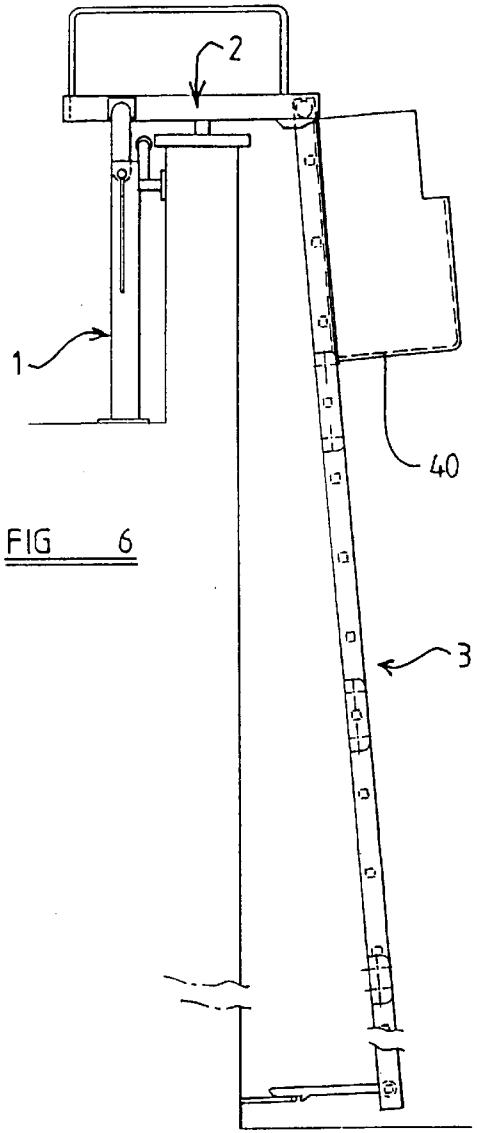
FIG. 6 is a schematic side view showing the FIG. 4 escape apparatus in its position of use with the child carrier positioned at the top of the unfolded ladder of the apparatus.
Figure 4:
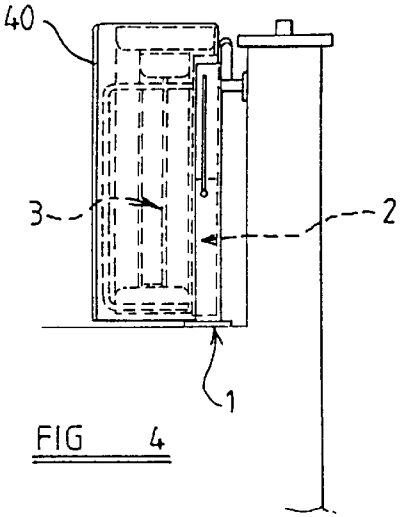
FIG. 4 is a schematic side view of a second embodiment of an escape apparatus according to the present invention in the stowed condition, which apparatus has a cover which also serves as a child carrier in use of the apparatus.
Figure 5:
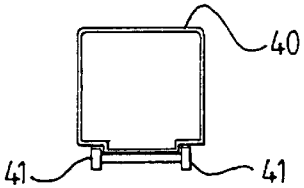
FIG. 5 is a schematic end view of the child carrier of the FIG. 4 escape apparatus.
Figure 12:
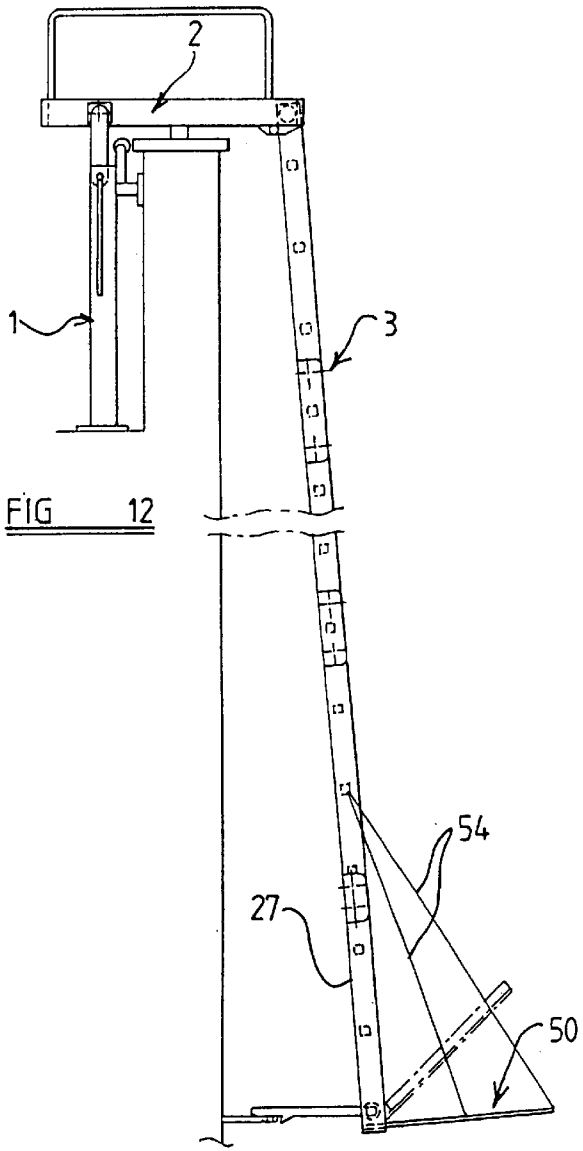
FIG. 12 is a schematic side view of the FIG. 8 escape apparatus, showing the lowermost section of the ladder in an unfolded condition with the rescue platform opened out into in its position of use.
Figure 11:
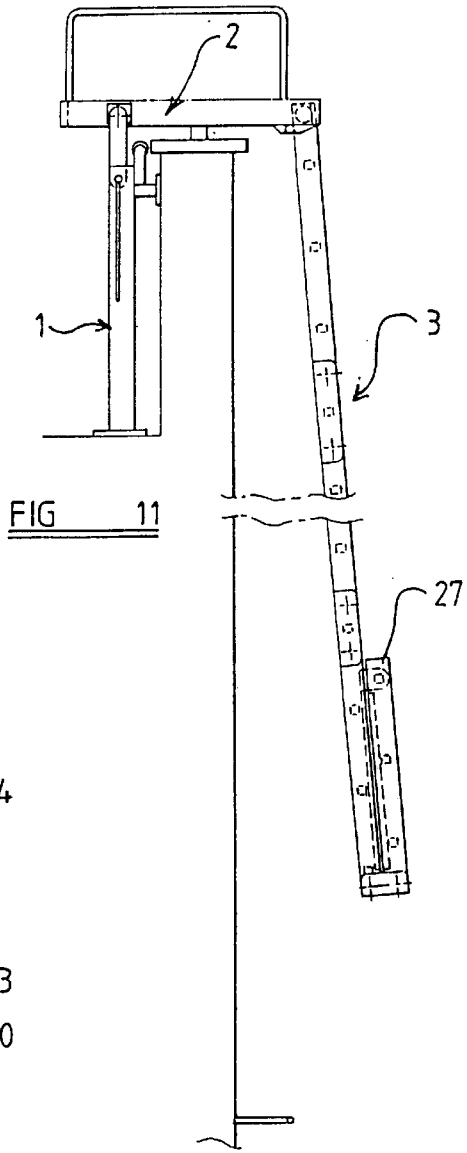
FIG. 11 is a schematic side view of the FIG. 8 escape apparatus, showing a lowermost section of the ladder in a folded condition with the rescue platform in its folded condition.
Figure 10:
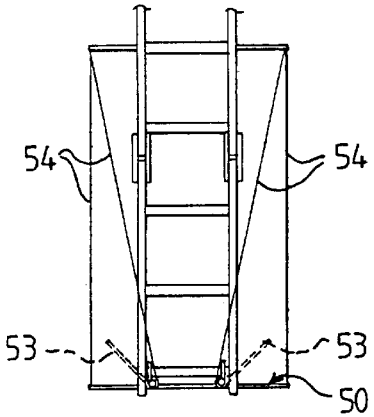
FIG. 10 is a fragmentary front view of the FIG. 8 escape apparatus, showing the rescue platform in an unfolded position of use.
Figure 8:
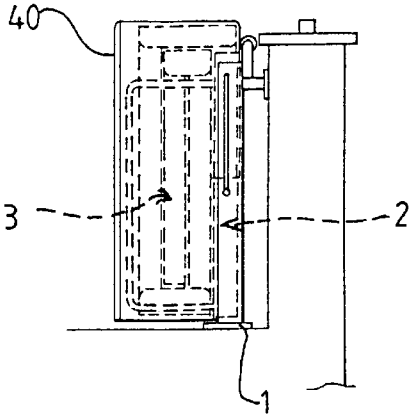
FIG. 8 is a schematic side view illustrating a third embodiment of an escape apparatus according to the invention in its stowed position, which apparatus incorporates a foldable rescue platform at a lower end section of the ladder.
Figure 9:
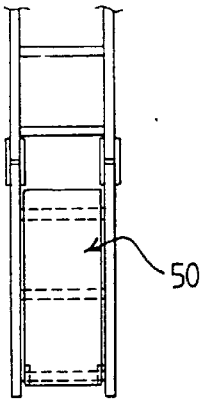
FIG. 9 is a fragmentary front view of the FIG. 8 escape apparatus, showing the rescue platform in a folded stowed condition.

FIGS. 4 to 7 illustrate a second embodiment of the invention in which escape apparatus as described with reference to FIGS. 1 to 3 is enclosed in a cover 40 when in the stowed position. The cover 40 is a box-like structure made of a suitably rigid material and is serves as a child carrier in conjunction with the described escape apparatus to enable a baby or small child to be safely lowered to the ground. To this end, as illustrated in FIG. 5, the rear of the carrier 40 is shaped to fit between the sides 41 of the ladder 3 and may be provided with a roller or rollers so that the carrier is guided as the cover is lowered down the extended ladder 3 from the stage 2 to the ground. Suitable lowering means are provided, for example in the form of a cable 42 which is connected to the carrier 40 and is paid out in a controlled manner from a hand winch or self-reeling drum 43 provided with a centrifugal brake. FIG. 6 and 7 illustrate the lowering of the baby carrier 40 from the top of the extended ladder, where the carrier is loaded, to the bottom of the extended ladder, where the carrier is unloaded. The carrier 40 is held in its loading position at the top of the ladder either by the lowering cable 42 or by a separate quick-release catch. The interior of the carrier 40 may be fitted with a safety harness for securing the baby or child to be lowered in the carrier.

FIGS. 8 to 12 illustrate a third embodiment of the present invention in which an escape apparatus as described with reference to FIGS. 1 to 7 is additionally provided with a rescue platform 50 for use in situations where it is not practical to provide a ladder which reaches the ground, for example in the case of the upper storeys of blocks of flats.

As shown in FIGS. 8 to 12, a lowermost section 27 of the ladder is fitted with such a rescue platform 50 to provide a temporary refuge for people who are unable to reach the ground while they wait for rescue. It is envisaged that the platform 50 could safely accommodate two average adults and one or two children.

The platform 50 takes the form of a foldable structure comprising a main plate 51 and two side plates 52 and 53. The main plate is pivotally mounted on the bottom rung 52 of the ladder 3 from a stowed position against the lowermost section 27 the ladder 3 and the two side plates 52 and 53 are hinged to the sides of the main plate and arranged to fold in behind the main plate in the stowed position of the platform 50. The side plates 52 and 53 are spring-loaded so that they open outwards automatically when the main plate drops down. The platform would be supported by engagement with rigid abutments (not illustrated) on the ladder 3 and by a number of flexible ties 54 connected between the ladder 3 and the plates 51, 52 and 53. The supporting action of the ties 54 may be enhanced to attaching them to spring-loaded anchor points projecting from the sides of the ladder and thereby effectively widening the supporting framework.

It is envisaged that the child carrier and the rescue platform could be provided as separate optional accessories to the basic escape apparatus described with reference to FIGS. 1 to 3.

I claim:

1. An escape apparatus for installation within an upper storey of a building in the proximity of an emergency exit opening such as a window, which apparatus comprises:

a foldable ladder carried by a stage which is mounted on a fixed mounting frame for movement together with the folded ladder between a upright position against the mounting frame to a position of use in which the stage may be projected through the emergency exit opening and in which the ladder may be unfolded from the stage to form a rigid ladder extending downwardly from the stage outside such opening;

the apparatus being characterized by securing means for fixing the mounting frame with a slideway of the mounting frame in an upright position, the stage being slidable along the slideway of the mounting frame, and the stage being pivotally connected to the frame by a link which has one end pivotally connected to the stage for rotation of the link relative to the stage and another end of the link connected to a pin that is slidable along a slot in the slideway, and allowing rotation of the link relative to the slideway; the link facilitating sliding and pivoting movement of the stage from the retracted upright position into the said position of use in which the stage extends transversely of the slideway of the mounting frame, thereby being extendable through the emergency exit opening.

2. An escape apparatus according to claim 1, wherein the securing means fix the mounting frame to the wall and/or floor of the building.

3. An escape apparatus according to claim 1, wherein the frame carries a stage guide roller for guiding the stage in its pivoting movement relative to the mounting frame.

4. An escape apparatus according to claim 1, wherein the ladder comprises a plurality of rigid ladder sections hingedly connected together.

5. An escape apparatus according to claim 4, wherein the ladder comprises a series of progressively shorter rigid ladder sections hingedly connected together by brackets of progressively shorter length, whereby shorter sections of the ladder are accommodated within longer sections in a coiled folded condition of the ladder.

6. An escape apparatus according to claim 1, wherein a first end of a first section of the ladder carries a roller which is captive within and slidable along a channel of the stage from a trailing edge of the stage to an opposite, leading edge of the stage.

7. An escape apparatus according to claim 6, wherein the stage carries a ladder guide roller towards the leading edge thereof for guiding the ladder into an unfolded position whereby the ladder extends away from the stage.

8. An escape apparatus according to claim 1, wherein the ladder is provided with latching means for engaging complementary latching means fixed to the outside wall of the building or the ground to stabilize the ladder in its unfolded position.

9. An escape apparatus according to claim 1, including a child carrier for locating between the sides of the ladder and means for controllably lowering the child carrier down the unfolded ladder from the stage.

10. An escape apparatus according to claim 9, wherein the means for controllably lowering the child carrier comprises a cable paid out from a drum provided with a centrifugal brake.

11. An escape apparatus according to claim 10, wherein the drum comprises a rewinding arrangement from automatically drawing the empty child carrier back to the stage for re-use.

12. An escape apparatus according to claim 10, wherein the child carrier forms a cover for the escape apparatus in its stored position.

13. An escape apparatus according to claim 1, comprising a folding rescue platform fitted to a lowermost section of the ladder and openable to form a temporary place of safety for people escaping from the building.

14. An escape apparatus according to claim 13, wherein the rescue platform is adapted to open automatically when the ladder is unfolded.

15. An escape apparatus according to claim 14, wherein the rescue platform comprises a main plate pivotally mounted on a rung of the ladder and two side plates hinged to the sides of the main plate and arranged to fold in behind the main plate in a stowed position of the main plate against the ladder.

16. An apparatus according to claim 13 further comprising a latching member carried on the lowermost section of the ladder and configured for engaging a complementary latching member fixed to the outside wall of a building.

* * * * *